US007375610B2

(12) United States Patent
Cheng et al.

(10) Patent No.: US 7,375,610 B2
(45) Date of Patent: May 20, 2008

(54) TRANSFORMER AND ASSEMBLING PROCESS THEREOF

(75) Inventors: Jui-Chu Cheng, Taoyuan Hsien (TW); Tsai-Shen Lin, Taoyuan Hsien (TW); Su-Chiung Hsu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/555,542

(22) Filed: Nov. 1, 2006

(65) Prior Publication Data

US 2008/0055033 A1 Mar. 6, 2008

(30) Foreign Application Priority Data

Aug. 31, 2006 (TW) ..... 95132229 A

(51) Int. Cl.
*H01F 27/28* (2006.01)
*H01F 27/24* (2006.01)

(52) U.S. Cl. ..... 336/212; 336/200; 336/211

(58) Field of Classification Search ..... 336/200, 336/223, 212, 232, 220–221, 83
See application file for complete search history.

(56) References Cited

U.S. PATENT DOCUMENTS 6,278,353 B1 * 8/2001 Downing et al. ..... 336/200
6,377,150 B1 * 4/2002 Heinrich et al. ..... 336/55
6,741,155 B2 * 5/2004 Usui ..... 336/200
6,927,661 B2 * 8/2005 He et al. ..... 336/200

* cited by examiner

*Primary Examiner*—Anh T Mai
(74) *Attorney, Agent, or Firm*—Kirton & McConkie; Evan R. Witt

(57) ABSTRACT

A transformer includes a magnetic core assembly, a circuit board, a plurality of pins and at least an interface layer. The magnetic core assembly includes a first magnetic part and a second magnetic part. The circuit board is arranged between the first magnetic part and the second magnetic part, and has a winding coil patterns including a primary winding coil and at least a secondary winding coil. The pins have first ends mounted onto the circuit board. The interface layer is arranged between the first magnetic part and the circuit board and/or between the second magnetic part and the circuit board such that the circuit board lies flat on the interface layer and is secured to the first magnetic part or the second magnetic part via the interface layer.

20 Claims, 9 Drawing Sheets

TRANSFORMER AND ASSEMBLING PROCESS THEREOF

FIELD OF THE INVENTION

The present invention relates to a transformer and a process of assembling the transformer.

BACKGROUND OF THE INVENTION

Transformers have become essential electronic components for various electronic devices such as power supply apparatus or power adapters. Since the electronic devices are developed toward small size and high power, the size of the transformers contained in the electronic devices should be minimized. Referring to FIG. 1, a schematic exploded view of a conventional transformer is illustrated. The transformer 1 of FIG. 1 principally comprises a circuit board 11, a plurality of pins 12, a magnetic core assembly 13 and a fixture member 14. The circuit board 11 is for example multi-layered circuit board and has thereon winding coil patterns including a primary winding coil and at least a secondary winding coil (not shown). The circuit board 11 has a hollow portion 111 at the center thereof and a plurality of conductive holes 112. The conductive holes 112 are distributed at bilateral sides of the circuit board 11 and connected to the winding coil patterns. First ends of the pins 12 are inserted and fixed into respective conductive holes 112. Second ends of the pins 12 are connected to corresponding contact pads on a system circuit board (not shown) according to a surface mount technology (SMT), such that the transformer 1 is mounted onto the system circuit board.

Please refer to FIG. 1 again. The magnetic core assembly 13 includes of the transformer 1 includes a first magnetic part 131 and a second magnetic part 132. The first magnetic part 131 includes a first sidewall 1311 and a first middle post 1312. A first indentation 1313 is formed between the first sidewall 1311 and the middle post 1312. The second magnetic part 132 includes a second sidewall 1321 and a second middle post 1322. A second indentation 1323 is formed between the second sidewall 1321 and the second middle post 1322. The first middle post 1312 of the first magnetic part 131 and the second middle post 1322 of the second magnetic part 132 are partially inserted into the hollow portion 111 of the circuit board 11. The circuit board 11 is accommodated within the space between the first indentation 1313 of the first magnetic part 131 and the second indentation 1323 of the second magnetic part 132. When the first magnetic part 131, the second magnetic part 132 and the circuit board 11 are combined with each other, the circuit board 11 is received between the first magnetic part 131 and the second magnetic part 132 and the first middle post 1312 and the second middle post 1322 are partially received in the hollow portion 111 of the circuit board 11.

The fixture member 14 includes at least a resilient clip. The first magnetic part 131 and the second magnetic part 132 have recesses 1314 and 1324, respectively. After the first magnetic part 131, the second magnetic part 132 and the circuit board 11 are combined with each other, the fixture member 14 clamps the recesses 1314 and 1324. Under this circumstance, the first magnetic part 131, the second magnetic part 132 and the circuit board 11 are fixed by the fixture member 14. The resulting structure of the transformer 1 is shown in FIG. 2. Due to an electromagnetic coupling effect generated between the magnetic core assembly 13 and the circuit board 11, voltage conversion is rendered. Moreover, for facilitating fixing the circuit board 11, dispensing adhesive 15 is coated on a small portion of the surface of the second indentation 1323 of the second magnetic part 132, so that the circuit board 11 is attached onto the second magnetic part 132.

The structure of the above transformer 1 still has some drawbacks. For example, since the dispensing adhesive 15 is coated on a small surface of the second indentation 1323 of the second magnetic part 132, the surface of the second indentation 1323 is not smooth. In addition, since the area of the second indentation 1323 of the second magnetic part 132 is small, it is difficult to manipulate the dispensing procedure. As a result, the dispensing adhesive 15 fails to be uniformed spread over the area of the second indentation 1323 and thus the circuit board 11 is not firmly secured to the second magnetic part 132. Under this circumstance, the circuit board 11 fails to lie flat on the second indentation 1323 and the circuit board 11 is tilted with respect to the surface of the second indentation 1323. The tilted circuit board 11 results in unevenness of the pins 12. Therefore, the pins fail to be fixed onto the system circuit board due to the poor wetting property and the poor solderability. Furthermore, after the transformer 1 and the system circuit board pass through a reflow furnace (not shown), the dispensing adhesive 15 is readily subjected to brittleness such that the circuit board 11 of the transformer 1 is not firmly secured to the magnetic core assembly 13. Furthermore, a gap is existed between the circuit board 11 and the surface of the second indentation 1323 and/or between the circuit board 11 and the surface of the first indentation 1313. Since the air contained in the gap is not a good thermally-conductive medium, the heat-dissipating efficiency of the transformer 1 is unsatisfied to meet the increasing power requirement of the power supply apparatus or power adapters.

In views of the above-described disadvantages resulted from the conventional method, the applicant keeps on carving unflaggingly to develop an improved transformer according to the present invention through wholehearted experience and research.

SUMMARY OF THE INVENTION

It is an object of the present invention to provide a transformer and a process of assembling the transformer by introducing an interface layer to position the circuit board and enhance heat dissipation.

It is another object of the present invention to provide a transformer and a process of assembling the transformer for controlling evenness of the pins of the transformer such that the transformer is firmly secured to a system circuit board according to a surface mount technology.

It is another object of the present invention to provide a transformer and a process of assembling the transformer for positioning the circuit board in the magnetic core assembly.

It is another object of the present invention to provide a transformer having simplified assembling process and structure.

In accordance with an aspect of the present invention, there is provided a transformer. The transformer includes a magnetic core assembly, a circuit board, a plurality of pins and at least an interface layer. The magnetic core assembly includes a first magnetic part and a second magnetic part. The circuit board is arranged between the first magnetic part and the second magnetic part, and has a winding coil patterns including a primary winding coil and at least a secondary winding coil. The pins have first ends mounted onto the circuit board. The interface layer is arranged between the first magnetic part and the circuit board and/or between the second magnetic part and the circuit board such that the circuit board lies flat on the interface layer and is secured to the first magnetic part or the second magnetic part via the interface layer.

In accordance with another aspect of the present invention, there is provided a process of assembling a transformer. Firstly, a circuit board, a plurality of pins, a magnetic core assembly and at least an interface layer are provided. The circuit board has a winding coil patterns including a primary winding coil and at least a secondary winding coil, the pins are mounted onto the circuit board, and magnetic core assembly includes a first magnetic part and a second magnetic part. Next, a first side of the interface layer is attached onto a second indentation of the second magnetic part and/or the first indentation of the first magnetic part. Next, the circuit board is attached onto a second side of the interface layer. Afterwards, the first magnetic part, the second magnetic part and the circuit board are combined with each other, and the combination of the first magnetic part, the second magnetic part and the circuit board is fixed.

In accordance with another aspect of the present invention, there is provided a transformer. The transformer includes a system circuit board, a magnetic core assembly and at least an interface layer. The system circuit board has a winding coil patterns including a primary winding coil and at least a secondary winding coil. The magnetic core assembly includes a first magnetic part and a second magnetic part, which are arranged on opposite sides of the system circuit board. The interface layer is arranged between the first magnetic part and the system circuit board and/or between the second magnetic part and the system circuit board.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
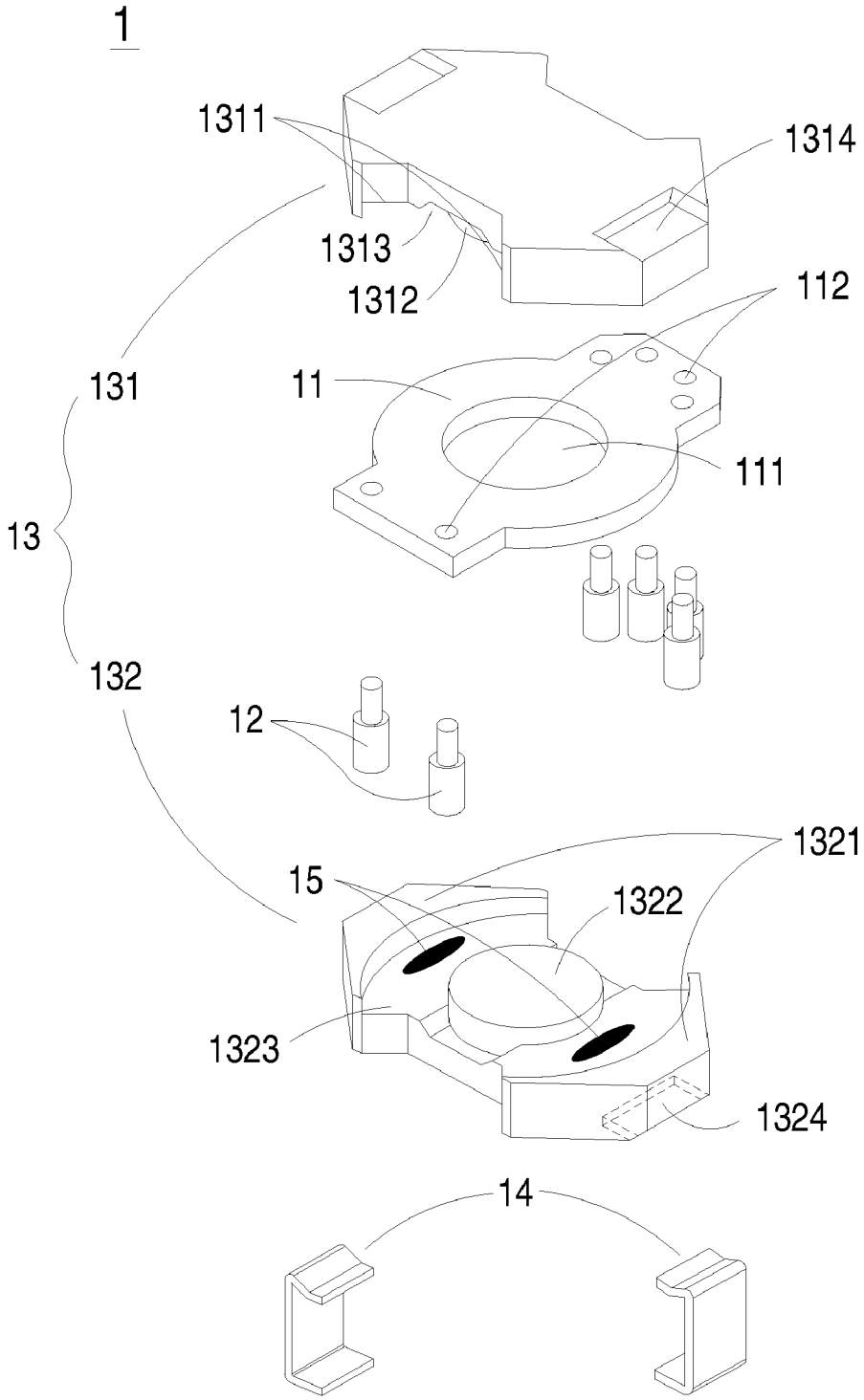
Fig. 1 Prior Art
FIG. 1 is a schematic exploded view of a conventional transformer.
Figure 2:
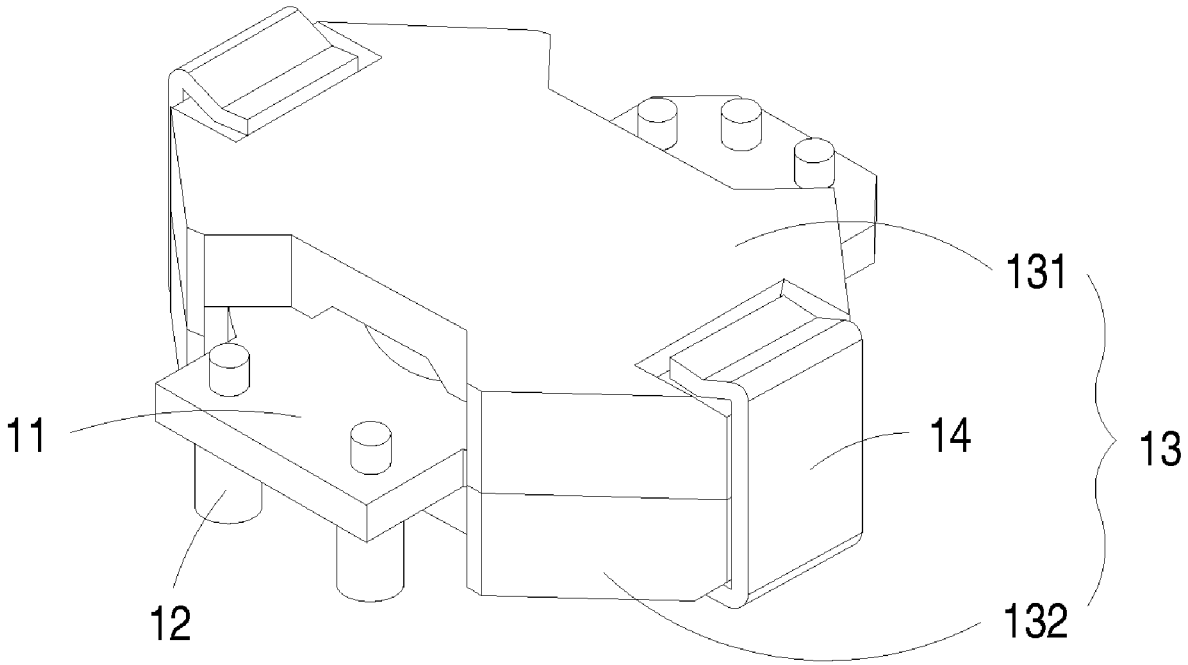
Fig. 2 Prior Art
FIG. 2 is a schematic assembled view illustrating the transformer of FIG. 1.
Figure 3:
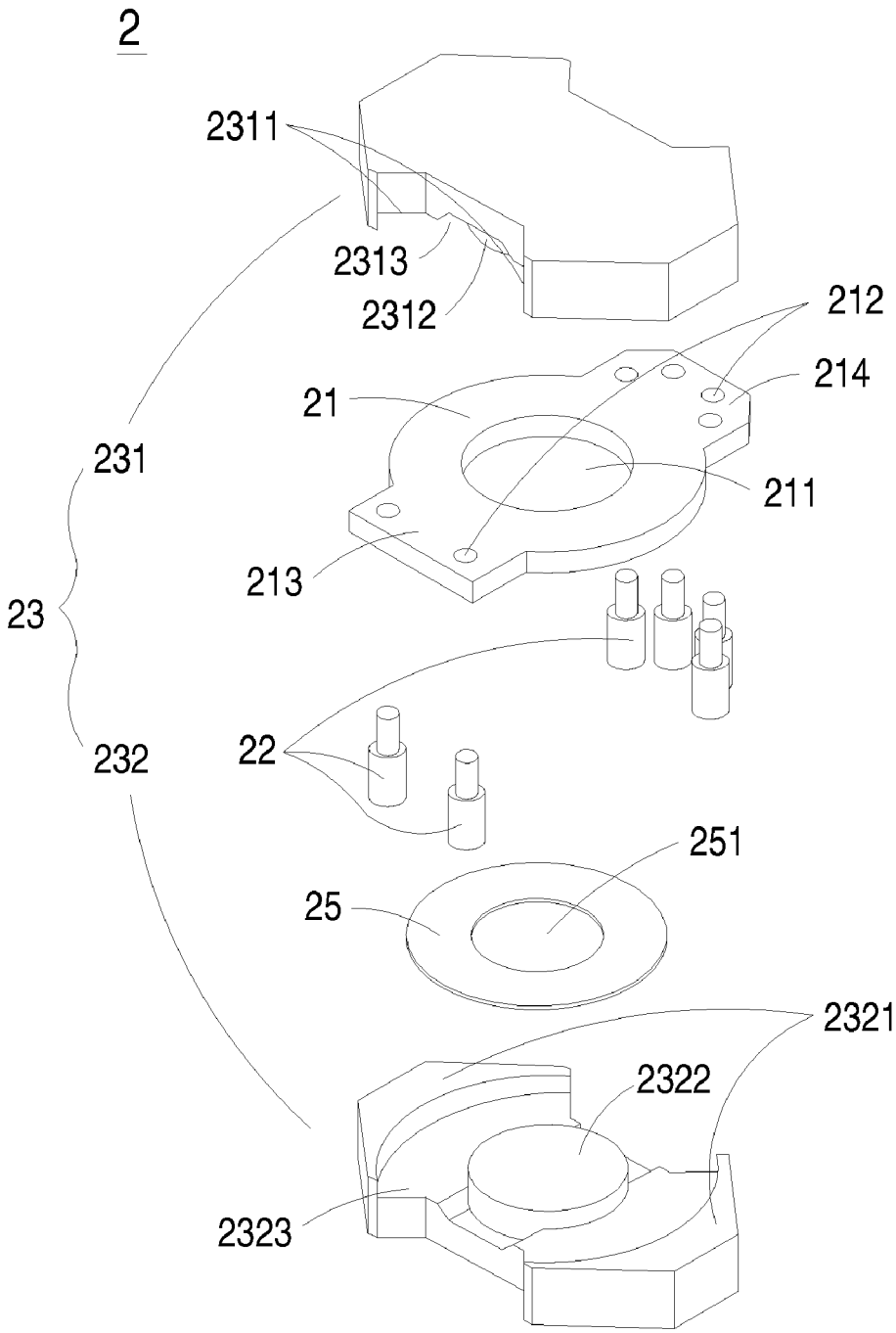
FIG. 3 is a schematic exploded view of a transformer according to a first preferred embodiment of the present invention.

Referring to FIG. 3, a schematic exploded view of a transformer according to a preferred embodiment of the present invention is illustrated. The transformer 2 of FIG. 3 is a SMD (Surface Mount Device) transformer, which includes a circuit board 21, a plurality of pins 22, a magnetic core assembly 23 and at least an interface layer 25. The circuit board 21 is for example multi-layered circuit board and has thereon winding coil patterns including a primary winding coil and at least a secondary winding coil (not shown). The principle of designing the winding coil patterns is known in the art, and is not redundantly described herein. The circuit board 21 has a hollow portion 211 at the center thereof and a plurality of conductive holes 212. The conductive holes 212 are distributed at bilateral sides 213 and 214 of the circuit board 21 and connected to the winding coil patterns of the circuit board 21. First ends of the pins 22 are inserted and fixed into respective conductive holes 212. Second ends of the pins 22 are connected to corresponding contact pads on a system circuit board (not shown) according to a surface mount technology, (SMT) such that the transformer 2 is mounted onto the system circuit board.

Please refer to FIG. 3 again. The magnetic core assembly 23 includes of the transformer 2 includes a first magnetic part 231 and a second magnetic part 232. The first magnetic part 231 includes a first sidewall 2311 and a first middle post 2312. A first indentation 2313 is formed between the first sidewall 2311 and the middle post 2312. The second magnetic part 232 includes a second sidewall 2321 and a second middle post 2322. A second indentation 2323 is formed between the second sidewall 2321 and the second middle post 2322. The first middle post 2312 of the first magnetic part 231 and the second middle post 2322 of the second magnetic part 232 are partially inserted into the hollow portion 211 of the circuit board 21. The circuit board 21 is accommodated within the space between the first indentation 2313 of the first magnetic part 231 and the second indentation 2323 of the second magnetic part 232. When the first magnetic part 231, the second magnetic part 232 and the circuit board 21 are combined with each other, the circuit board 21 is received between the first magnetic part 231 and the second magnetic part 232 and the first middle post 2312 and the second middle post 2322 are partially received in the hollow portion 211 of the circuit board 21. The bilateral sides 213 and 214 of the circuit board 21 are extended outsides the magnetic core assembly 23 and the pins 22 are perpendicular to the circuit board 21.

Figure 4:
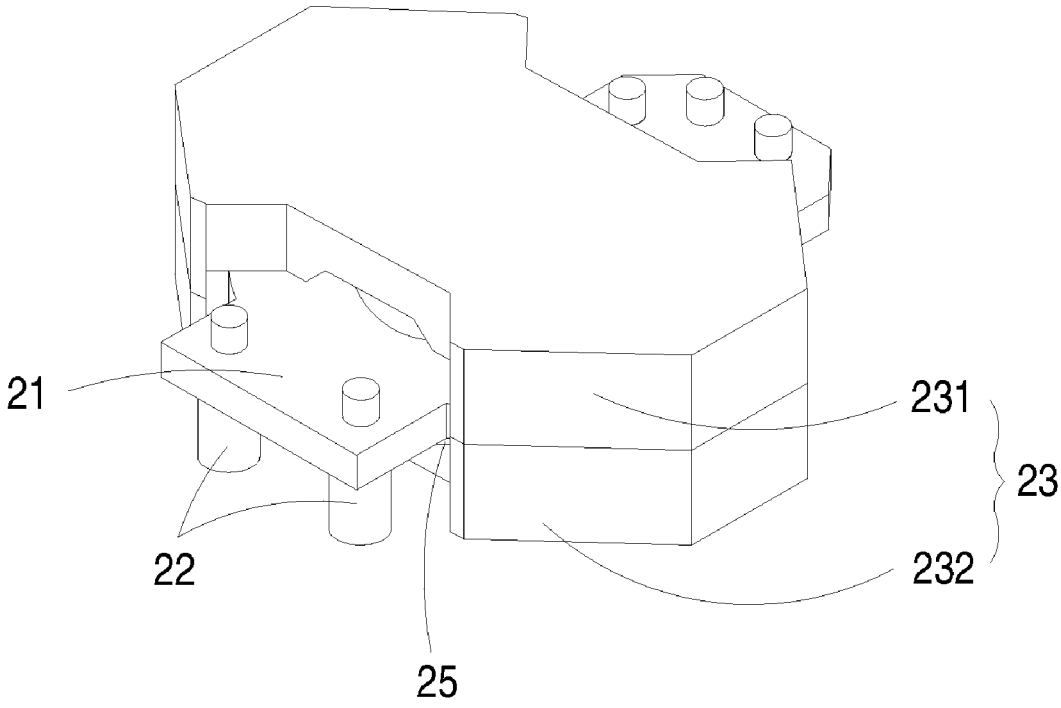
FIG. 4 is a schematic assembled view illustrating the transformer of FIG. 3.

For facilitating fixing the circuit board 21, the interface layer 25 is arranged between the second indentation 2323 of the second magnetic part 232 and the circuit board 21. Alternatively, the interface layer 25 may be arranged between the first indentation 2313 of the first magnetic part 231 and the circuit board 21. In accordance with a specific feature of the present invention, the top and bottom surfaces of the interface layer 25 are flat. Via the interface layer 25, the circuit board 21 is bonded onto the second indentation 2323 of the second magnetic part 232 and/or the first indentation 2313 of the first magnetic part 231. Afterwards, the first magnetic part 231, the second magnetic part 232 and the circuit board 21 are combined with each other to form the resulting structure of the transformer 2 as shown of FIG. 4.

In some embodiments, the interface layer 25 is a connection interface layer having flat top and bottom surfaces. The interface layer 25 has a perforation 251 corresponding to the hollow portion 211 of the circuit board 21. After the second middle post 2322 or the first middle post 2312 is penetrated through the perforation 251 of the interface layer 25, the interface layer 25 will be adhered onto the second indentation 2323 of the second magnetic part 232 or the first indentation 2313 of the first magnetic part 231. The contact area between the second indentation 2323 and the circuit board 21 or the contact area between the first indentation 2313 and the circuit board 21 is large enough to have the circuit board 21 lie flat onto the interface layer 25. In the assist of the interface layer 25, the circuit board 21 is firmly positioned and the pins 22 of the transformer 2 have excellent evenness. As a consequence, the problems of causing the poor wetting property and the poor solderability are avoided when the transformer 2 is mounted onto the system circuit board according to the surface mount technology (SMT), thereby increasing yield and reliability of the products. In addition, the problem of applying non-uniformed dispensing adhesive onto the contact surface is also overcome because the interface layer 25 is uniformly attached onto the second indentation 2323 of the second magnetic part 232 and/or the first indentation 2313 of the first magnetic part 231 and the attaching procedure is controlled without difficulties. Furthermore, after the transformer 2 and the system circuit board pass through a reflow furnace (not shown), the interface layer 25 is not subjected to brittleness such that the circuit board 21 of the transformer 2 is firmly secured to the magnetic core assembly 23.

In some embodiments, the interface layer 25 is a thermal pad. The thermal pad principally includes a first adhesive layer, a second adhesive layer and an internal layer, which is interposed between the first adhesive layer and second adhesive layer. The first adhesive layer and second adhesive layer have flat bonding surfaces. It is preferred that the internal layer 25 is made of a high thermally-conductive material. In other words, the interface layer 25 is effective for providing adhesive property and enhancing heat dissipation. In a case that the thermal pad is served as the interface layer 25, the gap existed between the circuit board 21 and the surface of the second indentation 2323 and/or the gap between the circuit board 21 and the surface of the first indentation 2313 are filled with the interface layer 25. As a consequence, the thermal resistance of the thermal conductive path from the circuit board 21 to the surroundings is reduced and the overall heat-dissipating efficiency of the transformer 2 is increased.

Figure 5:
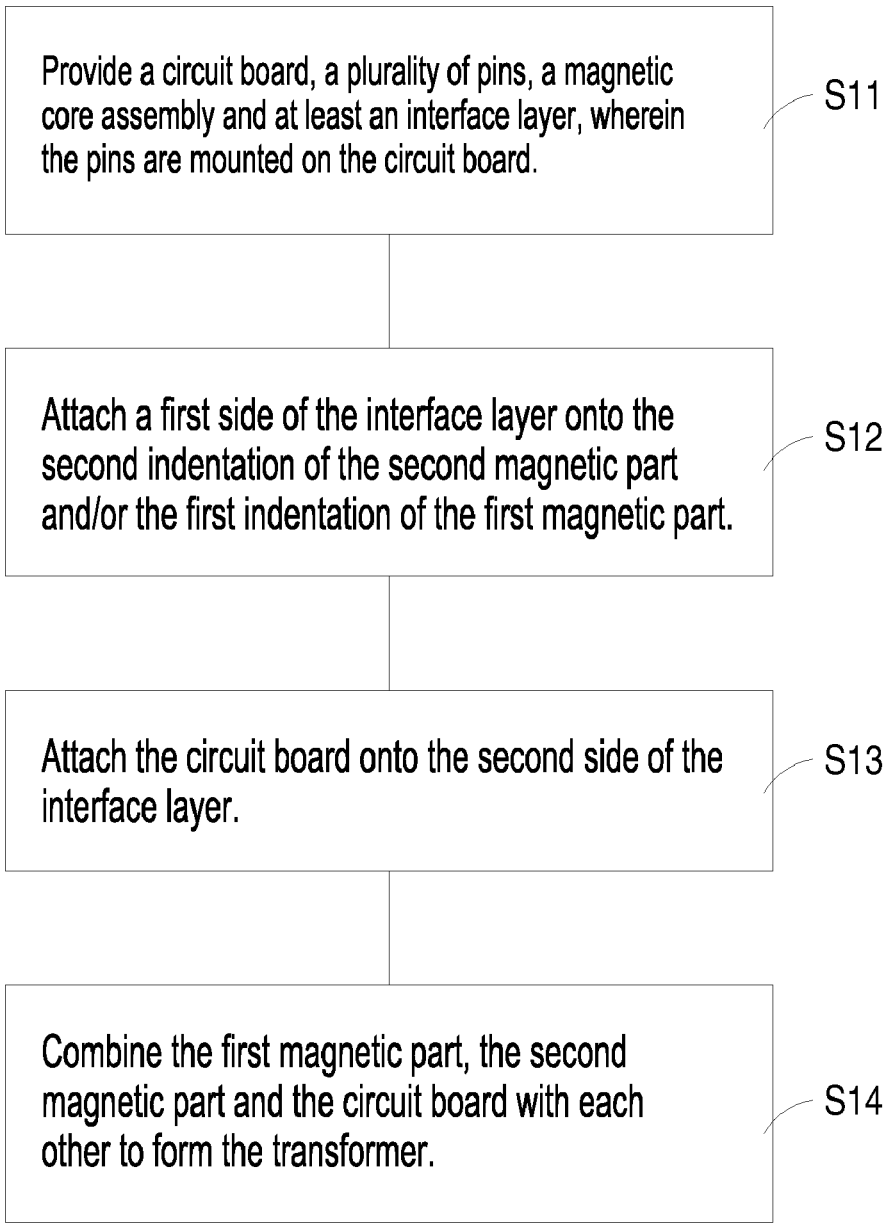
FIG. 5 is flowchart illustrating a process of assembling the transformer of the present invention.

Hereinafter, a process of assembling a transformer according to a preferred embodiment of the present invention will be illustrated with reference to the flowchart of FIG. 5. First of all, a circuit board 21, a plurality of pins 22, a magnetic core assembly 23 and at least an interface layer 25 are provided, wherein the pins 22 are mounted on the circuit board 21 (Step S11). The structures and the functions of the circuit board 21, the pins 22, the magnetic core assembly 23 and the interface layer 25 have been illustrated above, and are not redundantly described herein. Next, a first side of the interface layer 25 is bonded onto the second indentation 2323 of the second magnetic part 232 and/or the first indentation 2313 of the first magnetic part 231 (Step S12). Next, in the Step S13, the circuit board 21 is bonded onto the second side of the interface layer 25. Afterwards, the first magnetic part 231, the second magnetic part 232 and the circuit board 21 are combined with each other to form the transformer 2 (Step S14).

Figure 6:
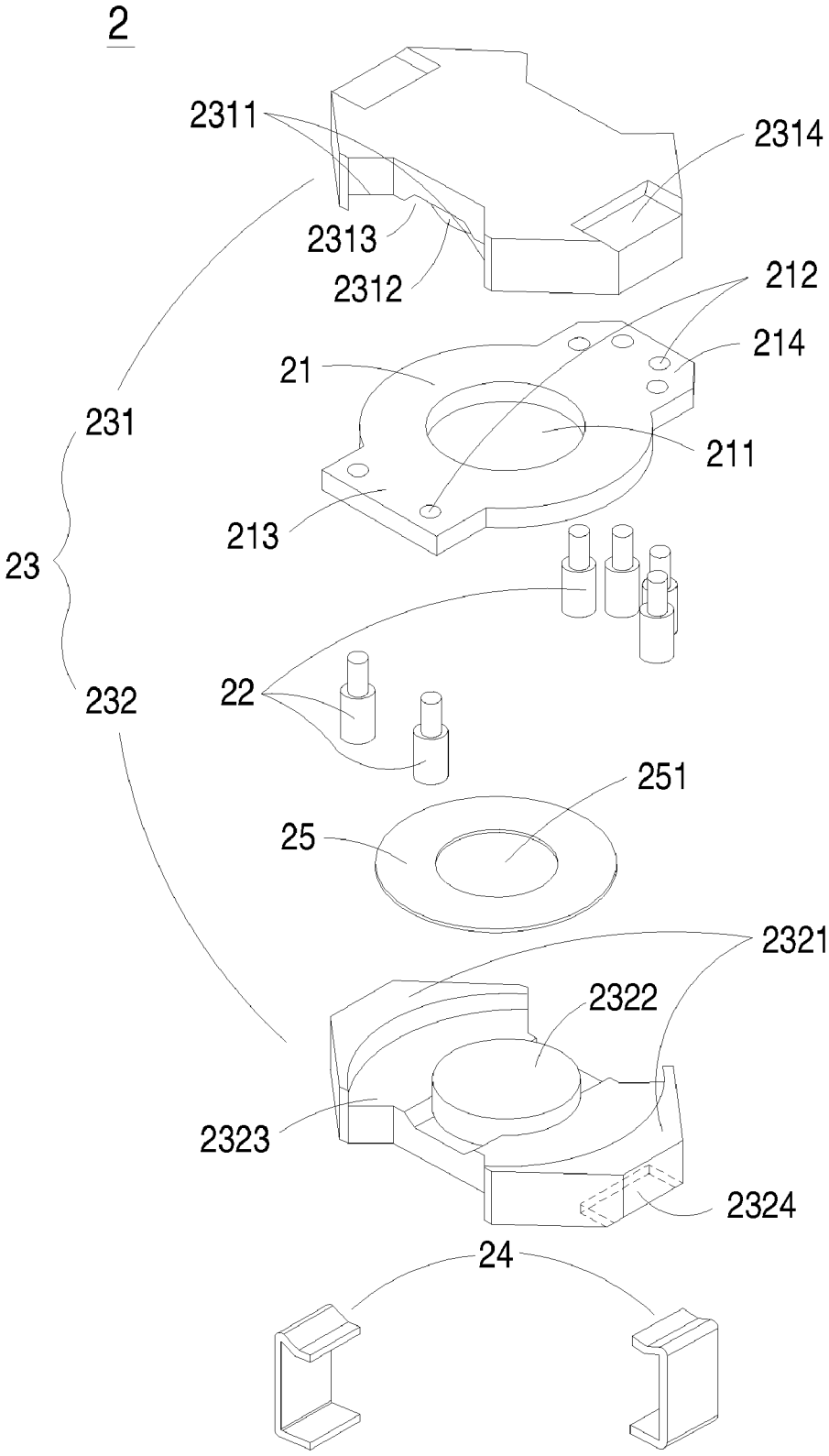
FIG. 6 is a schematic exploded view of a transformer according to a second preferred embodiment of the present invention.

A further embodiment of a transformer is illustrated in FIG. 6. The transformer 2 of FIG. 3 is also a SMD transformer, which includes a circuit board 21, a plurality of pins 22, a magnetic core assembly 23, a fixture member 24 and at least an interface layer 25. The circuit board 21 is for example multi-layered and has thereon winding coil patterns including a primary winding coil and at least a secondary winding coil (not shown). The principle of designing the winding coil patterns is known in the art, and is not redundantly described herein. The circuit board 21 has a hollow portion 211 at the center thereof and a plurality of conductive holes 212. The conductive holes 212 are distributed at bilateral sides 213 and 214 of the circuit board 21 and connected to the winding coil patterns of the circuit board 21. First ends of the pins 22 are inserted and fixed into respective conductive holes 212. Second ends of the pins 22 are connected to corresponding contact pads on a system circuit board (not shown) according to a surface mount technology, (SMT) such that the transformer 2 is mounted onto the system circuit board.

Please refer to FIG. 6 again. The magnetic core assembly 23 includes of the transformer 2 includes a first magnetic part 231 and a second magnetic part 232. The first magnetic part 231 includes a first sidewall 2311 and a first middle post 2312. A first indentation 2313 is formed between the first sidewall 2311 and the middle post 2312. The second magnetic part 232 includes a second sidewall 2321 and a second middle post 2322. A second indentation 2323 is formed between the second sidewall 2321 and the second middle post 2322. The first middle post 2312 of the first magnetic part 231 and the second middle post 2322 of the second magnetic part 232 are partially inserted into the hollow portion 211 of the circuit board 21. The circuit board 21 is accommodated within the space between the first indentation 2313 of the first magnetic part 231 and the second indentation 2323 of the second magnetic part 232. When the first magnetic part 231, the second magnetic part 232 and the circuit board 21 are combined with each other, the circuit board 21 is received between the first magnetic part 231 and the second magnetic part 232 and the first middle post 2312 and the second middle post 2322 are partially received in the hollow portion 211 of the circuit board 21. The bilateral sides 213 and 214 of the circuit board 21 are extended outsides the magnetic core assembly 23 and the pins 22 are perpendicular to the circuit board 21.

Figure 7:
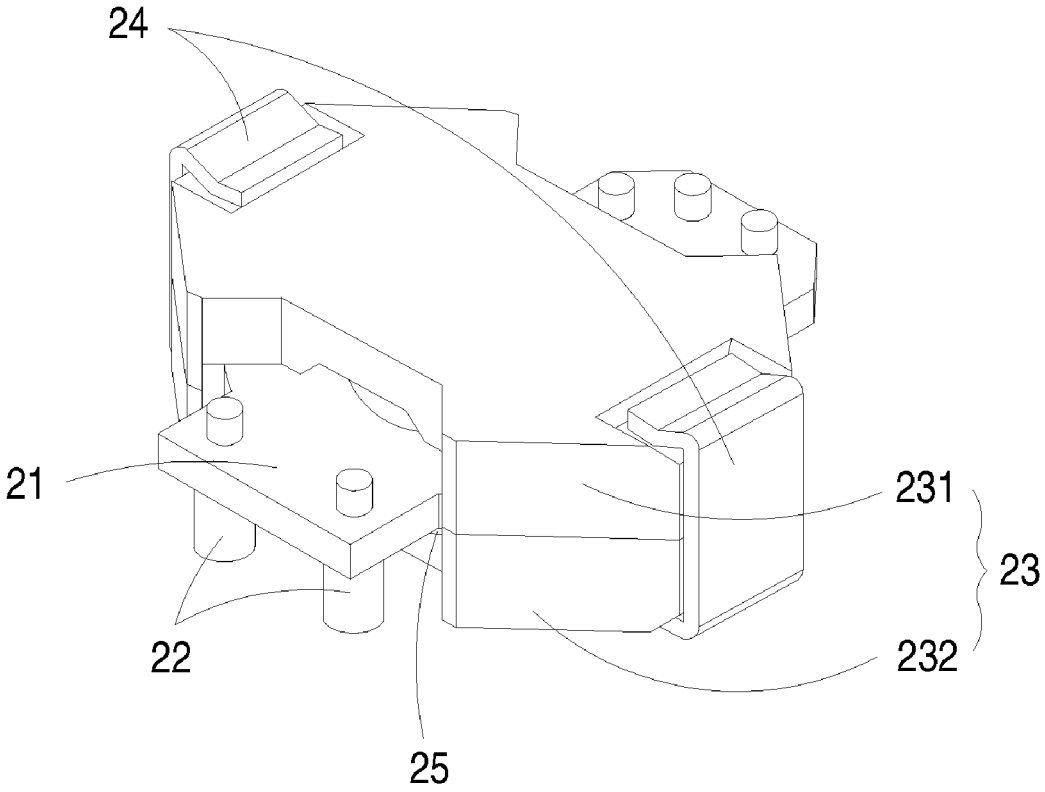
FIG. 7 is a schematic assembled view illustrating the transformer of FIG. 6.

The fixture member 24 includes at least a resilient clip. The first magnetic part 231 and the second magnetic part 232 have recesses 2314 and 2324, respectively. After the first magnetic part 231, the second magnetic part 232 and the circuit board 21 are combined with each other, the fixture member 24 clamps the recesses 2314 and 2324. Under this circumstance, the first magnetic part 231, the second magnetic part 232 and the circuit board 21 are fixed by the fixture member 24. Due to an electromagnetic coupling effect generated between the magnetic core assembly 23 and the circuit board 21, voltage conversion is rendered. For facilitating fixing the circuit board 21, the interface layer 25 is arranged between the second indentation 2323 of the second magnetic part 232 and the circuit board 21. Alternatively, the interface layer 25 may be arranged between the first indentation 2313 of the first magnetic part 231 and the circuit board 21. In accordance with the present invention, the top and bottom surfaces of the interface layer 25 are flat. Via the interface layer 25, the circuit board 21 is bonded onto the second indentation 2323 of the second magnetic part 232 and/or the first indentation 2313 of the first magnetic part 231. Afterwards, the first magnetic part 231, the second magnetic part 232 and the circuit board 21 are combined with each other to form the resulting structure of the transformer 2 as shown of FIG. 7.

In some embodiments, the interface layer 25 is a connection interface layer having flat top and bottom bonding surfaces. The interface layer 25 has a perforation 251 corresponding to the hollow portion 211 of the circuit board 21. After the second middle post 2322 or the first middle post 2312 is penetrated through the perforation 251 of the interface layer 25, the interface layer 25 will be adhered onto the second indentation 2323 of the second magnetic part 232 or the first indentation 2313 of the first magnetic part 231. The contact area between the second indentation 2323 and the circuit board 21 or the contact area between the first indentation 2313 and the circuit board 21 is large enough to have the circuit board 21 lie flat onto the interface layer 25. In addition, the interface layer 25 has substantially consistent thickness to provide a flat bonding surface. In the assist of the interface layer 25, the circuit board 21 is firmly positioned and the pins 22 of the transformer 2 have excellent evenness. As a consequence, the problems of causing the poor wetting property and the poor solderability are avoided when the transformer 2 is mounted onto the system circuit board according to the surface mount technology (SMT), thereby increasing yield and reliability of the products. In addition, the problem of applying non-uniformed dispensing adhesive onto the contact surface is also overcome because the interface layer 25 is uniformly attached onto the second indentation 2323 of the second magnetic part 232 and/or the first indentation 2313 of the first magnetic part 231 and the attaching procedure is controlled without difficulties. Furthermore, after the transformer 2 and the system circuit board pass through a reflow furnace (not shown), the interface layer 25 is not subjected to brittleness such that the circuit board 21 of the transformer 2 is firmly secured to the magnetic core assembly 23.

In some embodiments, the interface layer 25 is a thermal pad. The thermal pad principally includes a first adhesive layer, a second adhesive layer and an internal layer, which is interposed between the first adhesive layer and second adhesive layer. The first adhesive layer and second adhesive layer have flat bonding surfaces. It is preferred that the internal layer 25 is made of a high thermally-conductive material. In other words, the interface layer 25 is effective for providing adhesive property and enhancing heat dissipation. In a case that the thermal pad is served as the interface layer 25, the gap existed between the circuit board 21 and the surface of the second indentation 2323 and/or the gap between the circuit board 21 and the surface of the first indentation 2313 are filled with the interface layer 25. As a consequence, the thermal resistance of the thermal conductive path from the circuit board 21 to the surroundings is reduced and the overall heat-dissipating efficiency of the transformer 2 is increased.

Figure 8:
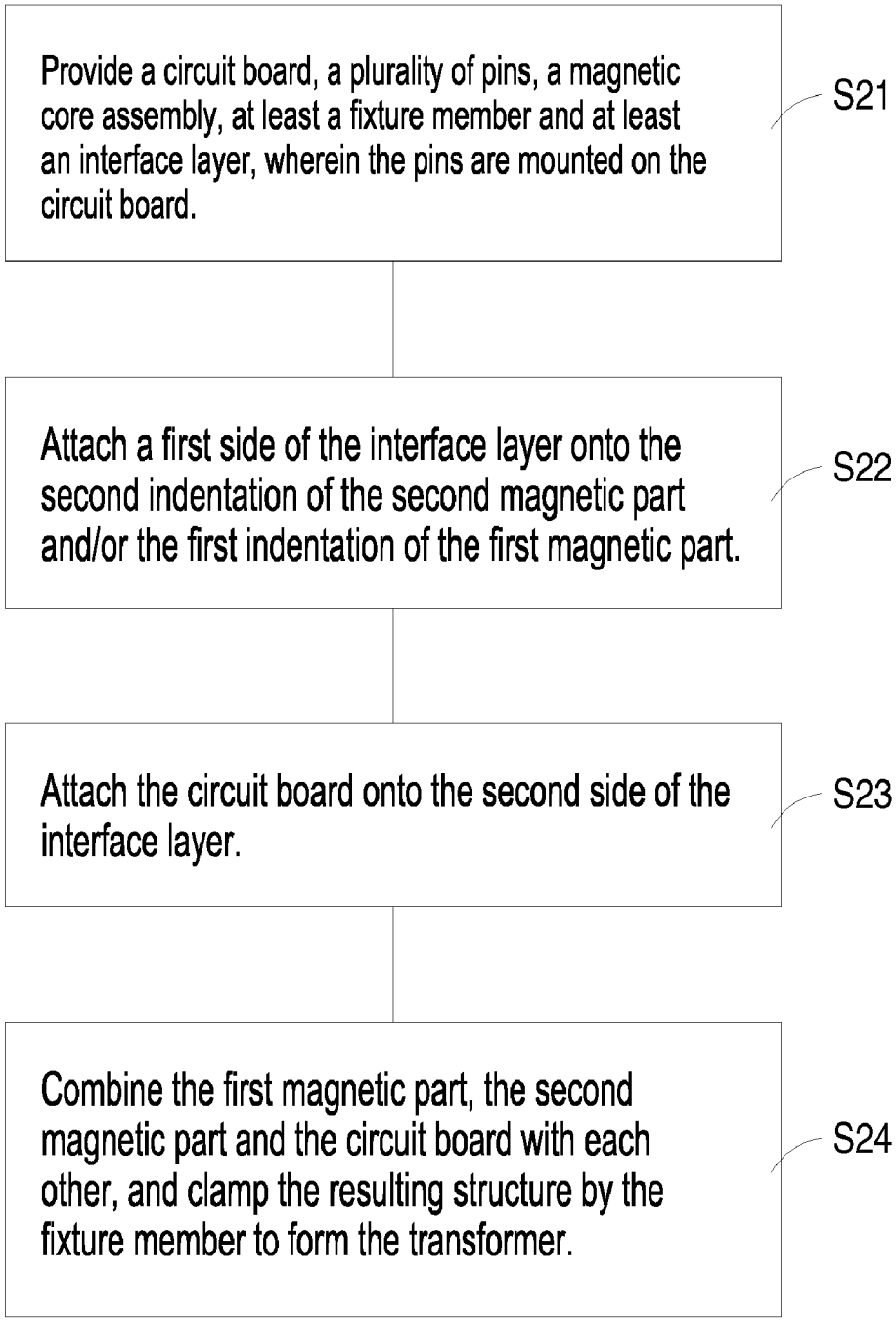
FIG. 8 is flowchart illustrating another process of assembling the transformer of the present invention.

Hereinafter, a process of assembling a transformer according to another preferred embodiment of the present invention will be illustrated with reference to the flowchart of FIG. 8. First of all, a circuit board 21, a plurality of pins 22, a magnetic core assembly 23, a fixture member 24 and at least an interface layer 25 are provided, wherein the pins 22 are mounted on the circuit board 21 (Step S21). The structures and the functions of the circuit board 21, the pins 22, the magnetic core assembly 23, the fixture member 24 and the interface layer 25 have been illustrated above, and are not redundantly described herein. Next, a first side of the interface layer 25 is bonded onto the second indentation 2323 of the second magnetic part 232 and/or the first indentation 2313 of the first magnetic part 231 (Step S22). Next, in the Step S33, the circuit board 21 is bonded onto the second side of the interface layer 25. Afterwards, the first magnetic part 231, the second magnetic part 232 and the circuit board 21 are combined with each other and the resulting structure is clamped by the fixture member 24 so as to form the transformer 2 (Step S24).

Figure 9:
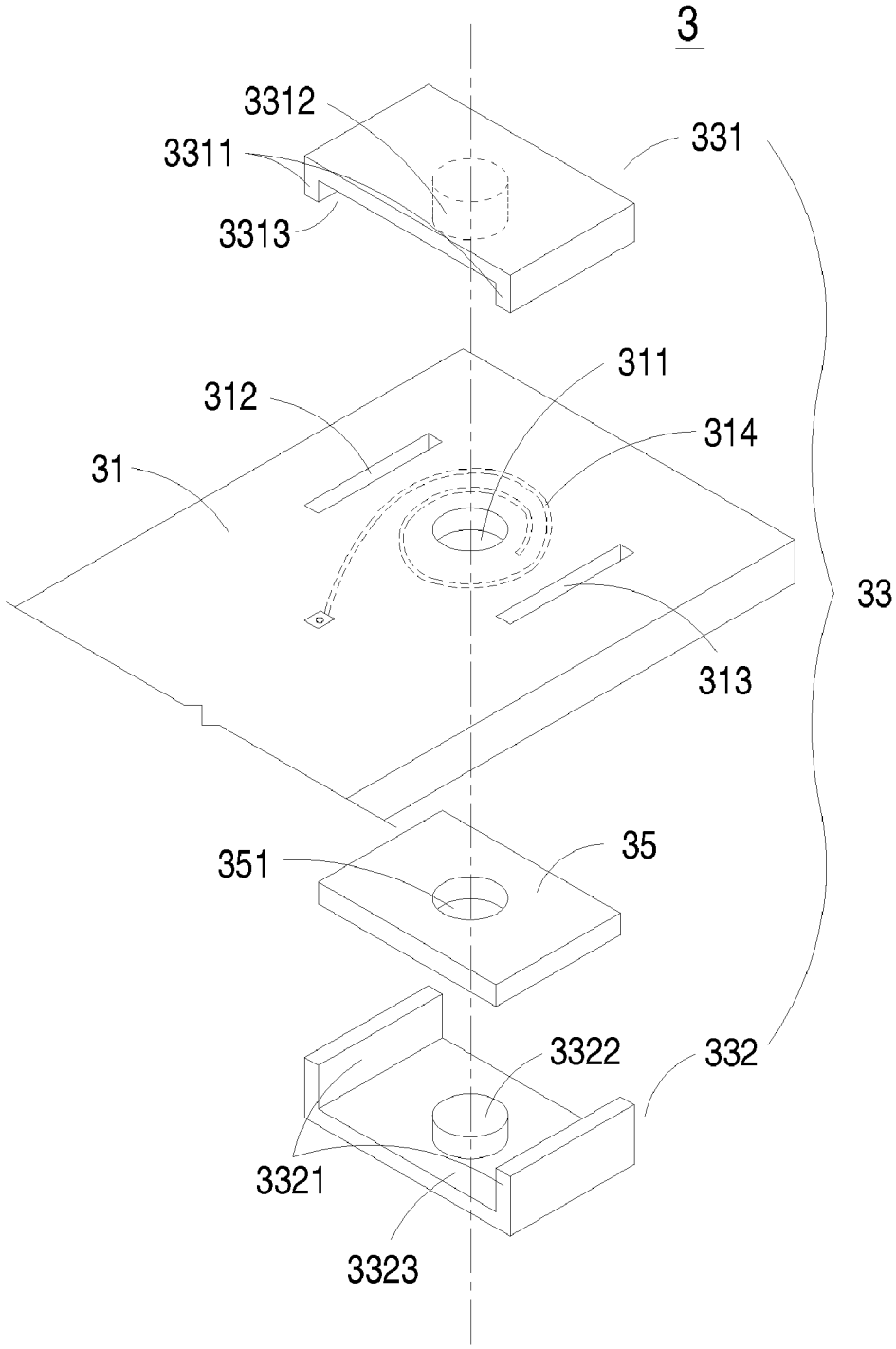
FIG. 9 is a schematic exploded view of a transformer according to a third preferred embodiment of the present invention.

A further embodiment of a transformer is illustrated in FIG. 9. The transformer 3 of FIG. 9 is for example a flat-plate transformer to be embedded into a system circuit board (not shown). The transformer 3 includes a system circuit board 31, a magnetic core assembly 33 and at least an interface layer 35. The system circuit board 31 is for example multi-layered circuit board and has thereon winding coil patterns 314 including a primary winding coil and at least a secondary winding coil (not shown). The system circuit board 31 has a first hollow portion 311 at the center thereof and a second hollow portion 312 and a third hollow portion 313 at bilateral sides of the first hollow portion 311. The winding coil patterns 314 enclose the first hollow portion 311.

Please refer to FIG. 9 again. The magnetic core assembly 33 includes of the transformer 3 includes a first magnetic part 331 and a second magnetic part 332. The first magnetic part 331 includes a first sidewall 3311 and a first middle post 3312. A first indentation 3313 is formed between the first sidewall 3311 and the first middle post 3312. The second magnetic part 332 includes a second sidewall 3321 and a second middle post 3322. A second indentation 3323 is formed between the second sidewall 3321 and the second middle post 3322. The first middle post 3312 of the first magnetic part 331 and the second middle post 3322 of the second magnetic part 332 are partially inserted into the first hollow portion 311 of the circuit board 31. The first magnetic part 331 and the second magnetic part 332 are arranged on opposite sides of the circuit board 31. The first sidewall 3311 of the first magnetic part 331 and the second sidewall 3321 of the second magnetic part 332 are partially received in the second hollow portion 312 and the third hollow portion 313.

In some embodiments, the interface layer 35 is a connection interface layer having flat top and bottom bonding surfaces. The interface layer 35 has a perforation 351 corresponding to the first hollow portion 311 of the system circuit board 31. After the second middle post 3322 or the first middle post 3312 is penetrated through the perforation 351 of the interface layer 35, the interface layer 35 will be adhered onto the second indentation 3323 of the second magnetic part 332 and/or the first indentation 3313 of the first magnetic part 331. The contact area between the second indentation 3323 and the circuit board 31 or the contact area between the first indentation 3313 and the circuit board 31 is large enough to have the circuit board 31 lie flat onto the interface layer 35. In addition, the interface layer 35 has substantially consistent thickness to provide a flat bonding surface. In the assist of the interface layer 35, the first magnetic part 331 and/or the second magnetic part 332 lie flat on the system circuit board 31. In some embodiments, the interface layer 35 is a thermal pad. The thermal pad principally includes a first adhesive layer, a second adhesive layer and an internal layer, which is interposed between the first adhesive layer and second adhesive layer. The first adhesive layer and second adhesive layer have flat bonding surfaces. It is preferred that the internal layer 35 is made of a high thermally-conductive material. In other words, the interface layer 35 is effective for providing adhesive property and enhancing heat dissipation. In a case that the thermal pad is served as the interface layer 35, the gap existed between the system circuit board 31 and the surface of the second indentation 3323 and/or the gap between the system circuit board 31 and the surface of the first indentation 3313 are filled with the interface layer 35. As a consequence, the thermal resistance of the thermal conductive path from the circuit board 31 to the surroundings is reduced and the overall heat-dissipating efficiency of the transformer 3 is increased.

From the above description, by interposing the interface layer between the first indentation of the first magnetic part and the circuit board and/or between the second indentation of the second magnetic part and the circuit board, the circuit board is firmly positioned and the pins of the transformer have excellent evenness. As a consequence, the problems of causing the poor wetting property and the poor solderability are avoided when the transformer is mounted onto the system circuit board according to the surface mount technology (SMT), thereby increasing yield and reliability of the products. In addition, the problem of applying non-uniformed dispensing adhesive onto the contact surface is also overcome because the interface layer is uniformly attached onto the second indentation of the second magnetic part and/or the first indentation of the first magnetic part and the attaching procedure is controlled without difficulties. Furthermore, after the transformer and the system circuit board pass through a reflow furnace, the interface layer is not subjected to brittleness such that the circuit board of the transformer is firmly secured to the magnetic core assembly.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a magnetic core assembly including a first magnetic part and a second magnetic part;

a circuit board arranged between said first magnetic part and said second magnetic part, and having a winding coil patterns including a primary winding coil and at least a secondary winding coil;

a plurality of pins having first ends mounted onto said circuit board; and at least an interface layer having at least one of flat top and bottom bonding surfaces and arranged between said first magnetic part and said circuit board and/or between said second magnetic part and said circuit board such that said circuit board lies flat on said interface layer and is secured to said first magnetic part and/or said second magnetic part via said interface layer.

2. The transformer according to claim 1 wherein said circuit board comprises:

a hollow portion at the center thereof; and a plurality of conductive holes distributed at bilateral sides thereof and connected to said winding coil patterns.

3. The transformer according to claim 2 wherein said first ends of said pins are inserted and fixed into respective conductive holes of said circuit board so as to be mounted onto said circuit board, and said pins have second ends connected to corresponding contact pads on a system circuit board.

4. The transformer according to claim 2 wherein said first magnetic part includes a first sidewall and a first middle post, a first indentation is formed between said first sidewall and said middle post, said second magnetic part includes a second sidewall and a second middle post, and a second indentation is formed between said second sidewall and said middle post.

5. The transformer according to claim 4 wherein said first middle post of said first magnetic part and said second middle post of said second magnetic part are partially inserted into said hollow portion of said circuit board, and said circuit board is accommodated within the space between said first indentation of the said magnetic part and said second indentation of said second magnetic part.

6. The transformer according to claim 4 wherein said bilateral sides of said circuit board are extended outsides said magnetic core assembly such that said pins are perpendicular to said circuit board.

7. The transformer according to claim 4 wherein said interface layer is arranged between said second indentation of said second magnetic part and said circuit board and/or between said first indentation of said first magnetic part and said circuit board.

8. The transformer according to claim 4 wherein said interface layer has a perforation corresponding to said hollow portion of said circuit board, and said interface layer is adhered onto said first indentation of said first magnetic part and/or said second indentation of said second magnetic part after said first middle post and/or said second middle post is penetrated through said perforation of said interface layer.

9. The transformer according to claim 8 wherein the contact area between said first indentation and said circuit board and/or the contact area between said second indentation and said circuit board is large enough to have said circuit board lie flat onto said interface layer, and said interface layer has substantially consistent thickness.

10. The transformer according to claim 1 wherein said interface layer is a thermal pad.

11. The transformer according to claim 1 further comprising a fixture member for fixing said magnetic core assembly and said circuit board after said first magnetic part, said second magnetic part and said circuit board are combined with each other.

12. The transformer according to claim 11 wherein said fixture member includes at least a resilient clip, said first magnetic part and said second magnetic part have respective recesses, and said fixture member clamps said recesses to fix said magnetic core assembly and said circuit board after said first magnetic part, said second magnetic part and said circuit board are combined with each other.

13. A process of assembling a transformer comprising:

providing a circuit board, a plurality of pins, a magnetic core assembly and at least an interface layer, wherein said circuit board has a winding coil patterns including a primary winding coil and at least a secondary winding coil, said pins are mounted onto said circuit board, said magnetic core assembly includes a first magnetic part and a second magnetic part, and said interface layer has at least one of flat top and bottom bonding surfaces;

attaching a first side of said interface layer onto a second indentation of said second magnetic part and/or said first indentation of said first magnetic part;

attaching said circuit board onto a second side of said interface layer; and combining said first magnetic part, said second magnetic part and said circuit board with each other, and fixing the combination of said first magnetic part, said second magnetic part and said circuit board.

14. A transformer comprising:

a system circuit board having a winding coil patterns including a primary winding coil and at least a secondary winding coil;

a magnetic core assembly including a first magnetic part and a second magnetic part arranged on opposite sides of said system circuit board; and at least an interface layer having at least one of flat top and bottom bonding surfaces and arranged between said first magnetic part and said system circuit board and/or between said second magnetic part and said system circuit board.

15. The transformer according to claim 14 wherein said system circuit board further includes a first hollow portion at the center thereof and a second hollow portion and a third hollow portion at bilateral sides of said first hollow portion.

16. The transformer according to claim 15 wherein said first magnetic part includes a first sidewall and a first middle post, a first indentation is formed between said first sidewall and said first middle post, said second magnetic part inclides a second sidewall and a second middle post, and a second indentation is formed between said second sidewall and said second middle post.

17. The transformer according to claim 16 wherein said first middle post of said first magnetic part and said second middle post of said second magnetic part are partially inserted into said first hollow portion of said system circuit board, and said first sidewall of said first magnetic part and said second sidewall of said second magnetic part are partially received in said second hollow portion and said third hollow portion of said system circuit board.

18. The transformer according to claim 16 wherein said interface layer has a perforation corresponding to said hollow portion of said circuit board, and said interface layer is adhered onto said first indentation of said first magnetic part and/or said second indentation of said second magnetic part after said first middle post and/or said second middle post is penetrated through said perforation of said interface layer.

19. The transformer according to claim 18 wherein the contact area between said first indentation and said circuit board and/or the contact area between said second indentation and said circuit board is large enough to have said circuit board lie flat onto said interface layer, and said interface layer has substantially consistent thickness.

20. The transformer according to claim 14 wherein said interface layer is a thermal pad.

* * * * *